US008929561B2

(12) United States Patent
Holland et al.

(10) Patent No.: US 8,929,561 B2
(45) Date of Patent: Jan. 6, 2015

(54) SYSTEM AND METHOD FOR AUTOMATED AUDIO MIX EQUALIZATION AND MIX VISUALIZATION

(75) Inventors: Jerremy Holland, Los Altos Hills, CA (US); Ken Matsuda, Sunnyvale, CA (US); Iroro F. Orife, San Francisco, CA (US); Paul Wen Shen, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 937 days.

(21) Appl. No.: 13/049,797

(22) Filed: Mar. 16, 2011

(65) Prior Publication Data

US 2012/0237040 A1 Sep. 20, 2012

(51) Int. Cl.

| | |
|---|---|
| ***H04R 3/02*** | (2006.01) |
| ***H04R 29/00*** | (2006.01) |
| ***H04R 3/04*** | (2006.01) |

(52) U.S. Cl.

CPC ..... *H04R 3/04* (2013.01); *H04R 2430/03* (2013.01); *H04R 29/008* (2013.01)

USPC ..... 381/73.1; 381/56

(58) Field of Classification Search

CPC ..... H04R 29/008; H04R 3/04; H04L 47/14; H04L 47/2416; H04L 47/25; H04L 1/1854; H04W 28/14; H04W 72/1215; H04W 72/1242; H04W 88/06

USPC ..... 381/56, 73.1, 119; 700/94; 379/93.01; 370/493

See application file for complete search history.

(56) References Cited

U.S. PATENT DOCUMENTS

| | | | | |
|---|---|---|---|---|
| 7,110,511 | B2 * | 9/2006 | Goodman | 379/93.01 |
| 7,602,723 | B2 * | 10/2009 | Mandato et al. | 370/236 |
| 2004/0105696 | A1 * | 6/2004 | Tsunoda et al. | 399/91 |
| 2008/0123610 | A1 * | 5/2008 | Desai et al. | 370/339 |
| 2013/0184020 | A1 * | 7/2013 | Hoshihara et al. | 455/501 |

FOREIGN PATENT DOCUMENTS

| | | | |
|---|---|---|---|
| WO | 2008/076607 | A2 | 6/2008 |
| WO | WO 2012101679 | A1 * | 8/2012 |

OTHER PUBLICATIONS

Carola Behrens, "Suppression of Pitched Musical Sources in Signal Mixtures," (M.A.Sc. Thesis), University of Victoria, 2005, (Available from ProQuest Dissertations & Theses database (Document ID 997895761), 114 pages.

Robert C. Maher, "Computer Processing of Audio Signals by Exclusion Filters," The Journal of the Acoustical Society of America, vol. 88, Issue S1, p. 188 (abstract), 1990. (Available online at http://www.coe.montana.edu/ee/rmaher/publications/maher_asa_1190_preprint.pdf, last visited Jun. 16, 2011), 13 pages.

* cited by examiner

*Primary Examiner* — Simon Sing
*Assistant Examiner* — Eugene Zhao
(74) *Attorney, Agent, or Firm* — Blakely, Sokoloff, Taylor & Zafman LLP

(57) ABSTRACT

Disclosed herein are systems, methods, and non-transitory computer-readable storage media for automatically analyzing, modifying, and mixing a plurality of audio signals. The modification of the audio signals takes place to avoid spectral collisions which occur when more than one signal simultaneously occupies one or more of the same frequency bands. The modifications mask out some signals to allow others to exist unaffected. Also disclosed herein is a method for displaying the identified spectral collisions superimposed on graphical waveform representations of the analyzed signals.

39 Claims, 5 Drawing Sheets

SYSTEM AND METHOD FOR AUTOMATED AUDIO MIX EQUALIZATION AND MIX VISUALIZATION

BACKGROUND

1. Technical Field

The present disclosure relates to audio and video editing and more specifically to systems and methods for assisting in and automating the mixing and equalizing of multiple audio inputs.

2. Introduction

Audio mixing is the process by which two or more audio signals and/or recordings are combined into a single signal and/or recording. In the process, the source signals' level, frequency content, dynamics, and other parameters are manipulated in order to produce a mix that is more appealing to the listener.

One example of audio mixing is done in a music recording studio as part of the making of an album. During the recording process, the sounds produced by the various instruments and voices are recorded on separate tracks. Oftentimes, the separate tracks have very little amplification or filtering applied to them such that, if left unmodified, the sounds of the instruments may drown out the voice of the singer. Other examples include the loudness of one instrument being greater than another instrument or the sounds from the multiple back-up singers being louder than the single lead singer. Thus, after the recording takes place, the process of mixing the recorded sounds occurs where the various parameters of each source signals are manipulated to create a balanced combination of the sounds that is aesthetically pleasing to the listener.

A similar condition exists during live performances such as at a music concert. In such situations, the sounds produced by each of the singers and musical instruments must be mixed and balanced in real-time before the combined sound signal is transmitted to the speakers and heard by the audience. Tests referred to as "sound checks" often take place prior to the event to ensure the correct balance of each of the sounds. These sorts of tests, however, have difficulty in accounting for the differences in, for example, the ambient sounds that occur before and during a concert. In addition, this type of mixing poses further challenges relating to real-time monitoring and reacting to performance conditions by adjusting of the parameters of each of the audio signals based on the changes in the other signals.

Another example of audio mixing is done during the post-production stage of a film or a television program by which a multitude of recorded sounds are combined into one or more channels. The different recorded sounds may include the dialogue of the actors, the voice-over of a narrator or translator, the ambient sounds, sound effects, and music. Similar to the occurrence in the music recording studio, the mixing step is often necessary to ensure that, for example, the dialogue by the actor or narrator is clearly heard over the ambient noises or background music.

In each of the above-mentioned situations, a mixing console is typically used to conduct the mixing. The mixing console contains multiple inputs for each of the various audio signals and controls for adjusting each signal and one or more outputs having the combined signals. A mixing engineer makes adjustments to each of the input controls while listening to the mixed output until the desired output mix is obtained. More recently, digital audio workstations have been implemented to serve the function of a mixing console.

In addition to the volume control of the entire signal, mixing often applies equalization filters to the signal. Equalization is the process of adjusting the strength of certain frequencies within a signal. For instance, a recording or mixing engineer may use an equalizer to make some high-pitches or frequencies in a vocal part louder while making low-pitches or frequencies in a drum part quieter. The granularity of equalization can range from simple adjustments of treble and boost all the way to having adjustments for every one-third octave. Each of these adjustments, however, require manual inputs and are only as precise as the range of frequencies that it is able to adjust. Once set, the attenuation and gains tend to be fixed for the duration of the recording. In addition, the use of such devices often require the expertise of a trained ear in addition to a good amount of trial and error.

A problem arises when the voice of a singer simultaneously occupies the same frequency range as another instrument. For the purposes of this disclosure, this is known as a "collision." Due to the physiological limitations of the human ear and the cognitive limits of the human brain, certain combinations of sounds are indistinguishable to a human listener. In addition, some sounds cannot be heard when they follow a louder sound. In such cases, the mix engineer attempts to cancel out certain frequencies of one sound in order for another sound to be heard. The problem with this solution is that an engineer's reaction time and perceptions are based on human cognition and are therefore susceptible to the same errors that are trying to be eliminated.

Thus, there is a perceived need for a solution that performs the mixing in real time or applies a mixing algorithm to one or more audio recording files that would assist in the mixing process.

In addition, it would also be helpful to provide a mixing engineer or other user a visual indication of where the overlaps or collisions occur, to allow for quick identification and corrective adjustments.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed are systems, methods, and non-transitory computer-readable storage media for the automation of the mixing of sounds through the detection and visualization of collisions. The method disclosed comprises receiving a plurality of signals, comparing the signals to one another, determining where the signals overlap or have collisions, and applying a masking algorithm to one or more of the signals that is based on the identified collisions. A method for displaying collisions is also disclosed and comprises receiving a plurality of signals, displaying the signals, comparing the signals to one another, determining where the signals overlap or have collisions, and highlighting the areas on the displayed signals where there is a collision.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

The present disclosure addresses the need in the art for tools to assist in the mixing of audio signals. A system, method and non-transitory computer-readable media are disclosed which automate the mixing process through the detection and visualization of audio collisions. A brief introductory description of a basic general purpose system or computing device in FIG. 1 which can be employed to practice the concepts is disclosed herein. A more detailed description of the automated mixing and visualization process will then follow.

These variations shall be discussed herein as the various embodiments are set forth. The disclosure now turns to FIG. 1.

Figure 1:
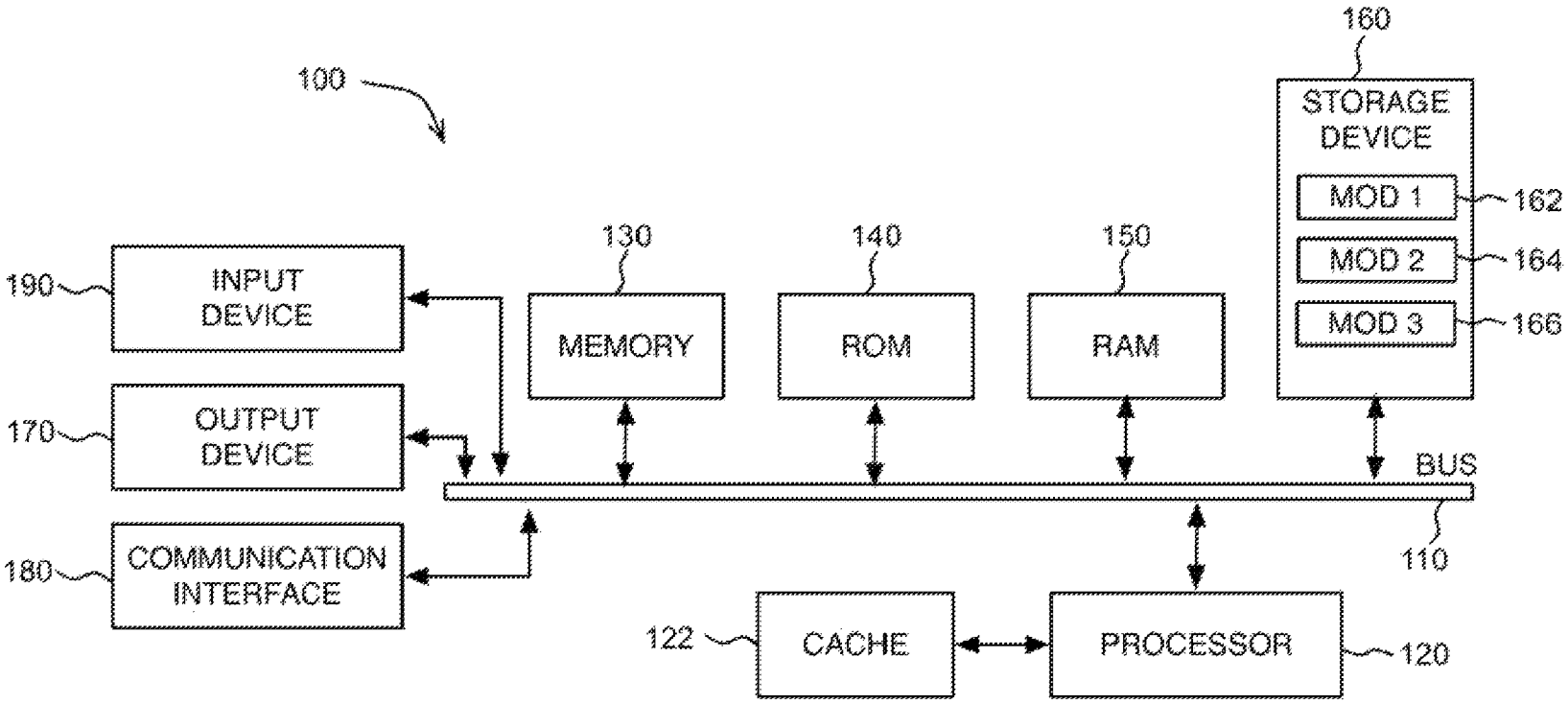
FIG. 1 illustrates an example of a system embodiment.

With reference to FIG. 1, an exemplary system 100 includes a general-purpose computing device 100, including a processing unit (CPU or processor) 120 and a system bus 110 that couples various system components including the system memory 130 such as read only memory (ROM) 140 and random access memory (RAM) 150 to the processor 120. The system 100 can include a cache 122 of high speed memory connected directly with, in close proximity to, or integrated as part of the processor 120. The system 100 copies data from the memory 130 and/or the storage device 160 to the cache 122 for quick access by the processor 120. In this way, the cache provides a performance boost that avoids processor 120 delays while waiting for data. These and other modules can control or be configured to control the processor 120 to perform various actions. Other system memory 130 may be available for use as well. The memory 130 can include multiple different types of memory with different performance characteristics. It can be appreciated that the disclosure may operate on a computing device 100 with more than one processor 120 or on a group or cluster of computing devices networked together to provide greater processing capability. The processor 120 can include any general purpose processor and a hardware module or software module, such as module 1 162, module 2 164, and module 3 166 stored in storage device 160, configured to control the processor 120 as well as a special-purpose processor where software instructions are incorporated into the actual processor design. The processor 120 may essentially be a completely self-contained computing system, containing multiple cores or processors, a bus, memory controller, cache, etc. A multi-core processor may be symmetric or asymmetric.

The system bus 110 may be any of several types of bus structures including a memory bus or memory controller, a peripheral bus, and a local bus using any of a variety of bus architectures. A basic input/output start-up instructions (BIOS) stored in ROM 140 or the like, may provide the basic routine that helps to transfer information between elements within the computing device 100, such as during start-up. The computing device 100 further includes storage devices 160 such as a hard disk drive, a magnetic disk drive, an optical disk drive, tape drive or the like. The storage device 160 can include software modules 162, 164, 166 for controlling the processor 120. Other hardware or software modules are contemplated. For example, in embodiments where the computing device 100 is connected to a network through the communication interface 180, some or all of the functions of the storage device may be provided by a remote server. The storage device 160 is connected to the system bus 110 by a drive interface. The drives and the associated computer readable storage media may provide nonvolatile storage of computer readable instructions, data structures, program modules and other data for the computing device 100. In one aspect, a hardware module that performs a particular function includes the software component stored in a non-transitory computer-readable medium in connection with the necessary hardware components, such as the processor 120, bus 110, display 170, and so forth, to carry out the function. The basic components are known to those of skill in the art and appropriate variations are contemplated depending on the type of device, such as whether the device 100 is a desktop computer, a laptop, a computer server, or even a small, handheld computing device such as, for example, a smart phone or a tablet PC.

Although the exemplary embodiment described herein employs the hard disk 160, it should be appreciated by those skilled in the art that other types of computer readable media which can store data that are accessible by a computer, such as magnetic cassettes, flash memory, digital versatile disks, cartridges, random access memories (RAMs) 150, read only memory (ROM) 140, a cable or wireless signal containing a bit stream and the like, may also be used in the exemplary operating environment. Non-transitory computer-readable storage media expressly exclude media such as energy, carrier signals, electromagnetic waves, and signals per se.

To enable user interaction with the computing device 100, an input device 190 represents any number of input mechanisms, such as a microphone for receiving sounds such as voice or instruments, a touch-sensitive screen for gesture or graphical input, keyboard, mouse, motion input, streaming audio signals, and so forth. An output device 170 can also be one or more of a number of output mechanisms known to those of skill in the art and include speakers, video monitors, and control modules. In some instances, multimodal systems enable a user to provide multiple types of input to communicate with the computing device 100. The communications interface 180 generally governs and manages the user input and system output. There is no restriction on operating on any particular hardware arrangement and therefore the basic features here may easily be substituted for improved hardware or firmware arrangements as they are developed.

For clarity of explanation, the illustrative system embodiment is presented as including individual functional blocks including functional blocks labeled as a "processor" or processor 120. The functions these blocks represent may be provided through the use of either shared or dedicated hardware, including, but not limited to, hardware capable of executing software and hardware, such as a processor 120, that is purpose-built to operate as an equivalent to software executing on a general purpose processor. For example the functions of one or more processors presented in FIG. 1 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 140 for storing software performing the operations discussed below, and random access memory (RAM) 150 for storing results. Very large scale integration (VLSI) hardware embodiments, as well as custom VLSI circuitry in combination with a general purpose DSP circuit, may also be provided.

The logical operations of the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. The system 100 shown in FIG. 1 can practice all or part of the recited methods, can be a part of the recited systems, and/or can operate according to instructions in the recited non-transitory computer-readable storage media. Such logical operations can be implemented as modules configured to control the processor 120 to perform particular functions according to the programming of the module. For example, FIG. 1 illustrates three modules Mod1 162, Mod2 164 and Mod3 166 which are modules configured to control the processor 120. These modules may be stored on the storage device 160 and loaded into RAM 150 or memory 130 at runtime or may be stored as would be known in the art in other computer-readable memory locations.

According to at least some embodiments that are implemented on system 100, storage device 160 may contain one or more files containing recorded sounds. In addition, the input device 190 may be configured to receive one or more sound signals. The sounds received by input device may have originated from a microphone, guitar pick-up, or an equivalent sort of transducer and are therefore in the form of an analog signal. Input device 190 may therefore include the necessary electronic components for converting each analog signal into a digital format. Furthermore, communication interface 180 may be configured to receive one or more recorded sound files or one or more streams of sounds in real time.

According to the methods discussed in more detail below, two or more sounds from the various sources discussed above are received by system 100 and are stored in RAM 150. Each of the sounds are then compared and analyzed by processor 120. Processor 120 performs analysis under the instructions provided by one or more modules in storage device 160 with possible additional controlling input through communication interface 180 or an input device 190. The results from the comparing an analyzing by processor 120 may be initially stored in RAM 150 and/or memory 130 and may also be sent to an output device 170 such as to a speaker or to a display for a user to see the graphical representation of the sound analysis. The results may also eventually be stored in storage device 160 or sent to another device through communication interface 180. In addition, the processor 120 may combine together the various signals into a single signal that, again, may be stored in RAM 150 and/or memory 130 and may be sent to an output device 170 such as a display for a user to see the graphical representation of the sound and/or to a speaker for a user to hear the sounds. That single signal may also be written to storage device 160 or sent to a remote device through communication interface 180.

Figure 2:
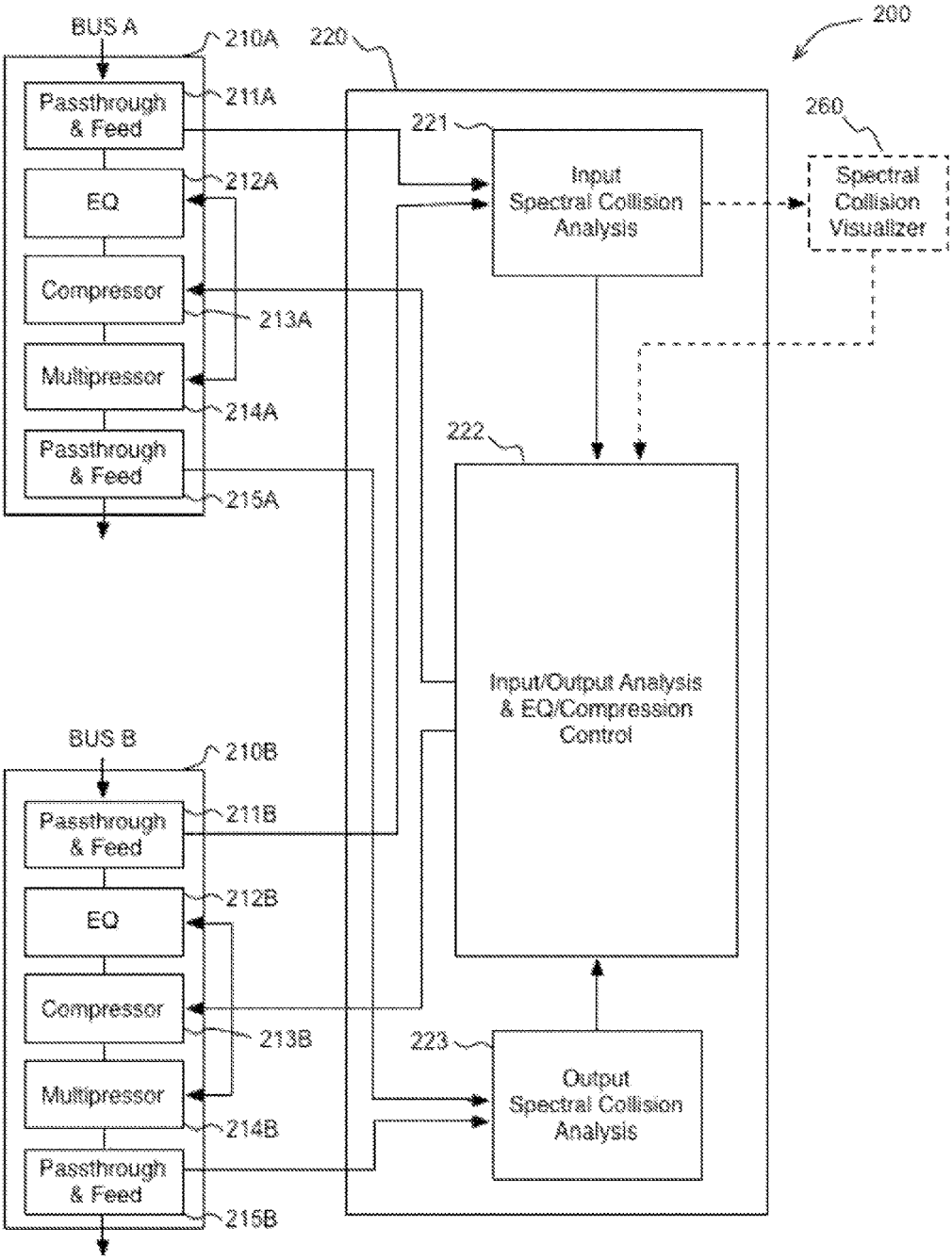
FIG. 2 illustrates another example of a system embodiment.

An alternative system embodiment is shown in FIG. 2. In FIG. 2, system 200 is shown in a configuration capable of receiving two different inputs: one sound input from BUS A into mixing console 210A and one input from BUS B into mixing console 210B. Both mixing console 210A and 210B contain the same components as most mixers or mixing consoles do, including input Passthrough & Feed modules 211A and 211B, EQ modules 212A and 212B, Compressor modules 213A and 213B, Multipressor modules 214A and 214B, and output Passthrough & Feed modules 215A and 215B. Rather than or in addition to the manual controls that are present on most mixers, however, mixing consoles 210A and 210B may be automatically controlled by a mix analysis and auto-mix module 220.

As shown in FIG. 2, auto-mix module 220 contains an input analysis module 221, a control module 222, and an optional output analysis module 223. According to at least some embodiments, the analysis module 221 receives the unfiltered sound signals from BUS A and BUS B through the respective input Passthrough & Feed modules 211A and 211B. The input analysis module 221 may receive sound signals in analog or digital format. According to one or more of the methods which will be discussed in more detail below, input analysis module 221 compares the two signals and identifies collisions that take place.

A collision is generally deemed to have occurred when both signals are producing the same frequency at the same time. Because recorded sounds can have a few primary or fundamental frequencies of larger amplitudes but then many harmonics at lower amplitudes, the collisions that are relevant may be only those that are above a certain minimum amplitude. Such a value may vary based on the nature of the sounds and is therefore preferably adjustable by the user of the system 200.

When the input analyzer 221 identifies a collision, it sends a message to control module 222. Control module 222 then sends the appropriate control signals to the gains and filters (EQ, Compressor, and Multipressor) located within each mixing console 210A and 210B. As the signals pass through the respective mixing console 210A and 210B, the gains and filters operate to minimize and/or eliminate the collisions detected in analysis module 221. In addition, an optional output analysis module 223 may be employed to determine whether the controls that were employed were sufficient to eliminate the collision and may provide commands to control module 222 to further improve the elimination of collisions.

While system 200 may be configured to operate autonomously, it may also enable a user to interact with the signals and controls. For example, a spectral collision visualizer 260 may be a part of system 200 and present a user graphical information. For example, visualizer 260 may present graphical waveforms of the signals on BUS A and BUS B. The waveforms may be shown in parallel charts or may be superimposed on one another. The visualizer 260 may also highlight the areas on the waveforms where collisions have been detected by analysis module 221. The visualizer 260 may also contain controls that may be operated by the user to, for example, manually override the operation of the control module 222 or to provide upper or lower control limits. The visualizer 260 may be a custom-built user interface specific to system 200 or may be a personal computer or a handheld device such as a smartphone that is communicating with auto-mix module 220.

Figure 3:
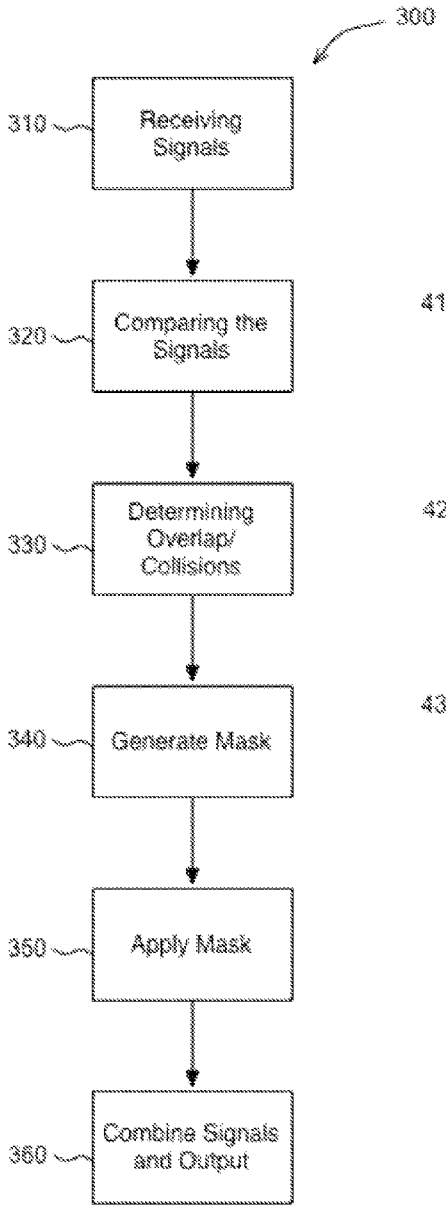
FIG. 3 illustrates a flow chart of an exemplary method.

Having disclosed some components of a computing system in various embodiments, the disclosure now turns to an exemplary method embodiment 300 shown in FIG. 3. For the sake of clarity, the exemplary method 300 may be implemented in either system 100 or system 200 or a combination thereof. Additionally, the steps outlined in method 300 may be implemented in any combination and order thereof, including combinations that exclude, add, or modify certain steps.

In FIG. 3, the process begins with receiving sound signals 310. As the method compares signals, there is generally two signals to be received but is not limited by any number greater than two. The signals may be of any nature or origin, but it is contemplated in some embodiments that one signal be that of a voice while the other signals can be sounds from musical instruments, other voices, background or ambient noise, computer-generated sounds such as sound effects, pre-recorded sounds or music. The sound signals may be occurring in real time or may be sound files stored in, for example storage device 160 or may be streaming through communication interface 180. The sound signals may also exist in any number of formats including, for example, analog, digital bit streams, computer files, samples, and loops.

Depending on the system, the sound signals may be received in any number of ways, including through an input device 190, a communication interface 180, a storage device 160, or through an auto-mix module 220. Depending on the source and/or format of the sound signals the receiving step may also include converting the signals into a format that is compatible with the system and/or other signals. For example, in some embodiments, an analog signal would preferably be converted into a digital signal.

After the signals are received, they are compared to one another in step 320. In this step, the signals are sampled and analyzed across a frequency spectrum. A sample rate determines how many comparisons are performed by the comparing step for each unit of time. For example, an analysis at an 8 kHz sample rate will take 8,000 separate samples of a one-second portion of the signals. Sample rates may range anywhere from less than 10 Hz all the way up to 192 kHz and more. The sample rate may be limited by the processor speed and amount of memory but also any improvement in the method gained by the increased sample rate may be lost due to the physical limitations of the human listener and its inability to notice the change in resolution.

For each sample, a comparison of the signals is performed at one or more frequencies. Because sound signals are being used, the range of the frequencies to be analyzed may be limited to the range of frequencies that may be heard by a human ear. It is generally understood that the human ear can hear sounds that are between about 20 Hz and 20 kHz. Within this range, it is preferred that the comparison of each signal may be performed within one or more bands. For example, each signal may be compared at the 20 different 1 kHz bands located between 20 Hz and 20 kHz. Another embodiment delineates the bands based on the physiology of the ear. For example, this embodiment would use what is known as "Bark scale" which breaks up the audible frequency spectrum into 24 bands that are narrow in the low frequency range and increase in width at the higher frequencies. Depending on the capabilities of the system and performance requirements of the user, the frequency bands may be further broken up by one or two additional orders of magnitude, i.e. ten sub-bands within each band of the Bark scale for a total of 240 frequency bands in the spectrum. In some embodiments, the bands may also be variable and based on the amplitude of the signal. Within each of these bands, comparison of the signals would take place.

In step 330, it is determined whether a collision has taken place among the signals. Generally, a "collision" occurs when more than one sound signal occupies the same frequency band as another sound signal. When such a condition exists over a period of time, the human ear has difficulty in distinguishing the different sounds. A common situation where a collision occurs is when a singer's voice is "drowned-out" by the accompanying instruments. Although the singer's voice may be easily heard when unaccompanied, it becomes difficult to hear when the other sounds are joined. Thus, it is important to identify the temporal locations and frequencies where such collisions occur to be dealt with in later steps.

Functionally, this determination may be carried out in any number of ways known to those skilled in the art. One option that may be employed is to transform each of the sounds signals into the frequency domain. This transformation may be performed through any known technique including applying a fast Fourier transform ("FFT") to the signals for each sample period. Once in the frequency domain, the signals may be compared to each other within each frequency band; for each frequency band, if both signals have an amplitude over a certain predefined or user-defined level, then the system would identify a collision to exist.

In situations where there is a desire for voices or sounds to stand out from the other mixed sound signals, as discussed above, priorities may be assigned to the various signals. For example, in the situation of a music recording studio where there is a singer and several musical instruments, the sound signal generated by the singer would be assigned the highest priority if the singer's voice is intended to be heard over the instruments at all times. Thus, in the occurrences where the sounds from the singer's voice are the same frequencies as the musical instruments (i.e., collisions), the sounds of the musical instruments may be attenuated or masked out during those occurrences, as discussed in more detail below.

It should be noted that in order for the collisions to be determined and evaluated accurately, the sound signals to be mixed must be in synchronization with one another. This is generally not a problem when the sound signals are being received in real time, but issues may arise when one or more signals is from an audio file while others are streaming. In such cases, user input may be required to establish synchronization initially. In some cases where a streaming input needs to be delayed, input delay buffers may also be employed to force a time lag in one sound or more signals.

In some embodiments, where it may be desirable to conserve computing resources, limiting the number of collisions to those that are most relevant may be done. Although there are many actual collisions that take place between signals, some collisions may be more relevant than others. For example, when the collisions take place between two or more sound signals but are all below a certain amplitude (such as below an audible level), it may not be important to identify such collisions. Such a "floor" may vary based on the sounds being mixed and may therefore be adjustable by a user. The level of amplitude may also vary based on the frequency band, as the human ear perceives the loudness of some frequencies differently than others. An example of equal loudness contours may be seen in ISO Standard 226.

Another example of a collision of less relevance is when the amplitude of the higher priority sound signal is far greater than the level of the lower priority sound signal. In such a situation, even though the two signals occupy the same frequency band, it would not be difficult for a listener to hear the priority sound simply due to it being much louder.

An example of a relevant collision may be when the two signals occupy the same frequency band and have similar amplitudes. In such occurrences, it may be difficult for a human ear to recognize the differences between the two sounds. Thus, it would be important to identify these collisions for processing.

Another example of a relevant collision may be when a lower-priority signal occupies the same frequency band as a higher priority signal and has a higher amplitude than the higher priority sound. The priority of a sound is typically based on the user's determination or selection of a particular signal. Sounds that typically have a higher priority may include voices of singers in a music recording and voices of actors or narrators in a video recording. Other sound signals may be assigned priorities that are less than the highest priority sounds but have greater priority than other sounds. For example, a guitar sound signal may have a lower priority than a voice, but may be assigned a higher priority than a drum. If all of these sounds were allowed to be played at the same level, a human ear would have difficulty recognizing all of the sounds, particularly those with the lower amplitudes while others are at higher amplitudes. Thus, it would be important to identify these relevant collisions in the sounds and a priority or processing by the methods in one or more of the subsequent steps.

Depending on the signals that are being mixed, the most relevant collisions are likely to only be a small fraction of the actual collisions. Thus, a conservation of resources may be realized when only requiring the system to identify, process, and apply a few collisions per unit of time rather than so many.

As the collisions are identified, an anti-collision mask or masking algorithm may be generated in step 340. The mask may be in any number of forms such as a data file or a real-time signal generated from an algorithm that is applied directly to the sounds as they are processed. In this later embodiment, the configuration is ideal for system 200 where there are two continuous streams of sound signals. In system 200, as the collisions are detected by analysis module 221 and sent to control module 222, a masking algorithm produces a signal generated by control module 222 and to be sent to the gains and filters in each mixing console 210A and 201B.

Alternatively, the anti-collision mask or masking algorithm may be in the form of a data file. The data file may preferably contain data relating to the temporal location and frequency band of the identified collisions (i.e., in time-frequency coordinates). In these embodiments, the mask may preferably be generated and used in system 100 which includes memory 130, RAM 150, and storage device 160 for storing the file temporarily or for long-term where it may be retrieved, applied, and adjusted any number of times. An anti-collision mask file may also exist in the form of another sound file. In such an embodiment, the mask music file may be played as just another sound signal but may be detected by the system as a masking file containing the instructions that would be used for applying a masking algorithm to one or more of the sound signals.

The mask may then be applied to the signal or signals in step 350. How the mask is applied is somewhat dependent upon the format of the mask. Referring back to system 200 in FIG. 2, one embodiment of the mask signal generated by control module 222 may be sent to each of the mixing consoles 210A and 210B. The mask signal may operate to control the various gains and compressors located in the mixing console. For example, during an occurrence where there is an identified collision between the sound signal on BUS A and BUS B, the mask signal may operate EQ 212B to filter out the BUS B sound signal at the range of frequency bands having the collision. The mask signal or algorithm may also or alternatively lower the volume of the second signal at all frequencies. The compressor and multipressor modules located within the mixing console may be controlled in a similar manner. The preferred result would be that, in the area where there was a collision, the sound signal from BUS A would be the only, or at least the most prominent, sound signal heard by the listener. Referring to the music recording example, a sound signal of a voice on BUS A that might not otherwise be heard over a musical instrument sound signal on BUS B may be more easily heard after a mask is applied to minimize some frequencies of the signal on BUS B. Similar results may be achieved when a mask is applied to the sound signals in a video, for example, enabling the sounds of the voices of actors and narrators to be heard over ambient background noises.

In the embodiments using an anti-collision mask in the form of a data file, as in system 100, the mask may loaded into RAM 150 and applied to the sound signals mathematically by processor 120. The application of the mask in this configuration may utilize the principles of digital signal processing to attenuate or boost the digital sound signals at the masking frequencies to achieve the desired result. Alternatively, the masking signal may be fed into one, a series of, or a combination of adaptive, notch, band pass or other functionally equivalent filters, which may be selectively invoked or adjusted, based on the masking input.

To which of the several sound signals the anti-collision mask is applied is preferably based on the priority of the signals. For example, a sound signal that has the highest priority would not be masked, but all other signals of lesser priority would. In such a configuration, the higher priority signals may be heard over the masked lower priority signals. In addition to general priorities, there may be conditional and temporal priorities that are established by the user. For example, a guitar solo or a particular sound effect may be a priority for a short period of time. Such priorities may be established by the user.

The general priorities may also be determined by the system. The system may do so by analyzing a portion of each sound signal and attempting to determine the nature of the sound. For example, voices tend to be within certain frequency ranges and have certain dynamic characteristics while sounds of instruments, for example, tend to have a broader and higher range of frequencies and different dynamic characteristics. Thus, through various sound and pattern recognition algorithms that are generally known in the art, the different sounds may be determined and certain default priorities may be assigned. Of course, a user may wish to deviate from the predetermined priorities for various reasons so the option is also available for the user to manually set the priorities.

In some embodiments, masks may also be applied to the sound signals having the highest priority, but in such cases the mask operates to boost the sound signal rather than attenuate. Thus, where there is a collision detected, the priority sound signal is amplified so that it may be heard over the other sounds. This is often referred to as "pumping." Of course, a any number of masks may be generated and is only limited by the preferences of the user.

Although the mask is generated based on the collisions that are detected between the signals, the application of the mask may be over a wider time or frequency band. For example, where a collision is detected between two signals within the frequency bands spanning 770 Hz and 1270 Hz and for a period of 30 ms, the mask may be applied to attenuate out the signal for a greater range of frequencies (such as from 630 Hz to 1480 Hz) and for a longer period of time (such as for one second or more). By doing so, the sound signal that is not cancelled out is left with an imprint of sorts and may therefore be more clearly heard.

Once the masks are applied to the appropriate sound signals, the signals may be combined in step 360 to produce a single sound signal. This step may utilize a signal mixing device (not shown) to combine the various signals such as in system 200 or may be performed mathematically on the digital signals by processor 120 in system 100. In system 100, the combined output signal may be sent to an output device 170 such as a speaker, streamed to an external device through communication interface 180, and/or stored in memory 130, RAM 150, and/or storage device 160.

Figure 4:
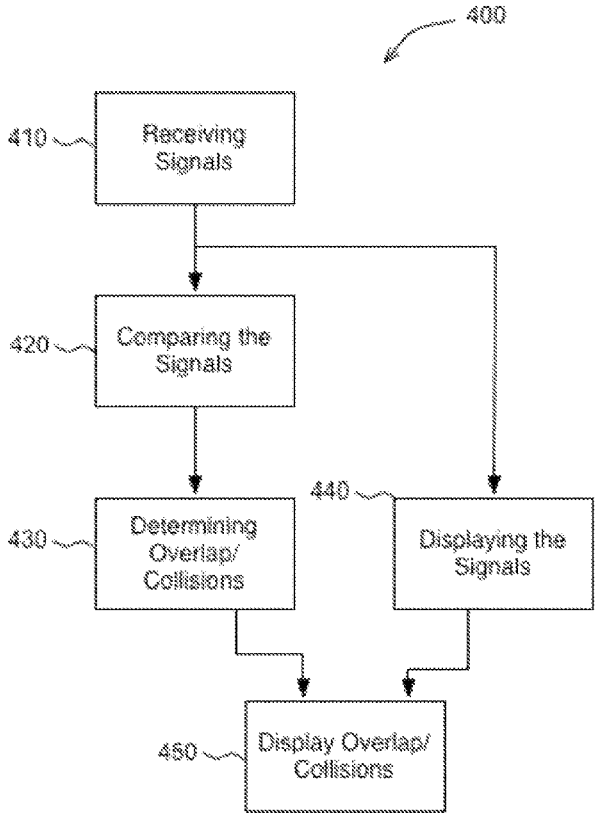
FIG. 4 illustrates a flow chart of another exemplary method.
Figure 5B:
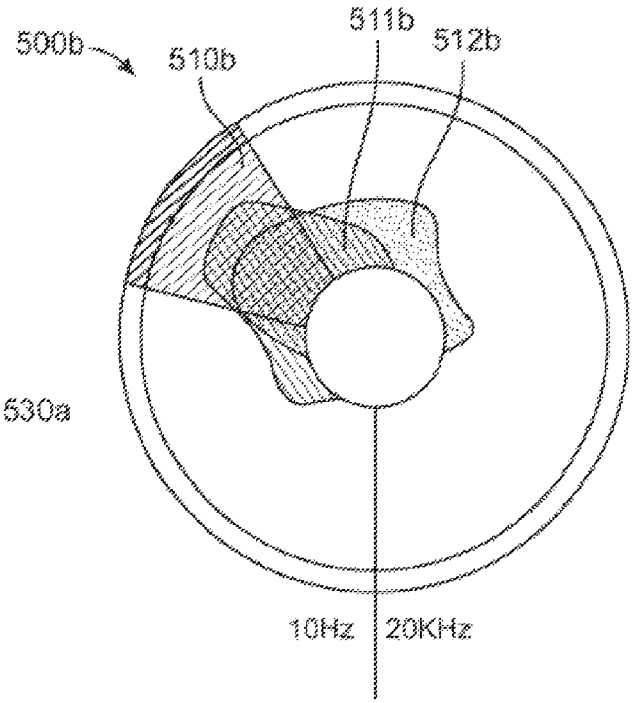
FIG. 5*a* and FIG. 5*b* are visual outputs of an exemplary method.
Figure 5A:
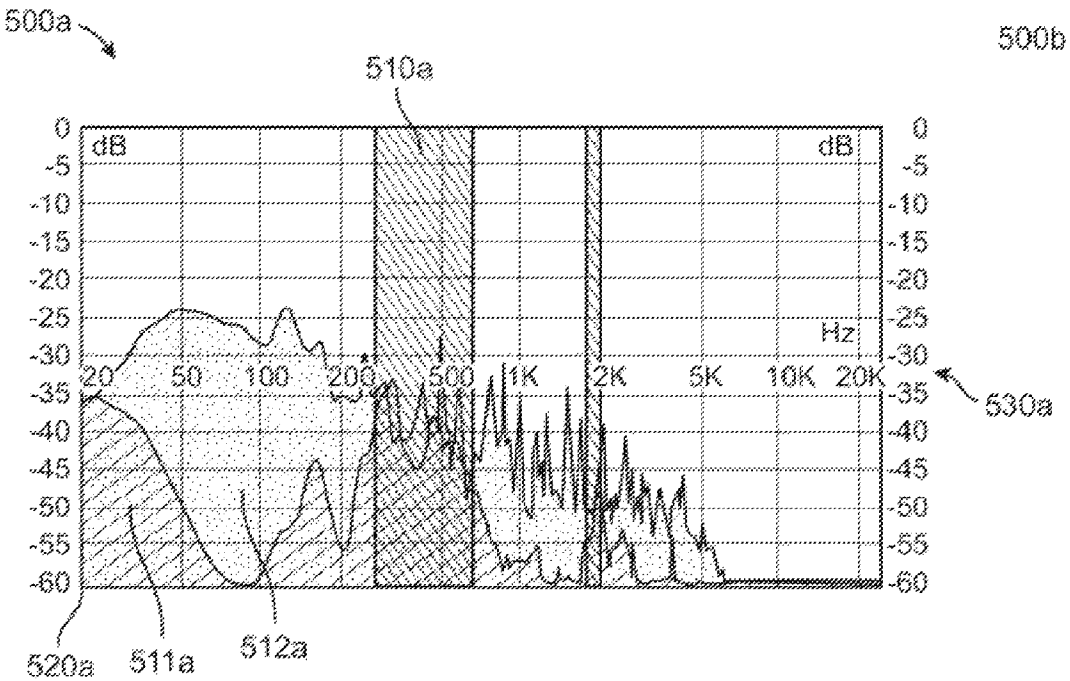

FIG. 4 illustrates an exemplary method 400 of displaying collisions on a graphical user interface to be viewed by a user. The receiving step 410, comparing step 420 and determining step 430 are similar to steps 310, 320, and 330 in method 300, discussed above. After receiving signals, the signals may be displayed in step 440. The signals may be displayed in system 100 by sending them to an output device 170 such as a computer monitor or touch screen. Similarly, the signals may also be displayed in system 200 on the spectral collision visualizer 260. In either case, the signals may be displayed in any number of ways. One graphical representation may be on a two-dimensional graph where the various sound signals are represented in waveforms of their respective integrated amplitudes on the Y-axis over a period of time on the X-axis. In this embodiment, the waveforms may be shown on separate axis or be superimposed on the same axis where they may be shown in different colors or weighted shades. Another embodiment displays a graphical representation of the waveforms on a three dimensional graph, where the frequency extends out on the Z-axis. Yet another embodiment displays the instantaneous waveforms across the frequency spectrum, as seen in FIG. 5*a*. In this embodiment, the instantaneous waveforms of the first signal 511*a* and second signal 512*a* across the frequency spectrum may be presented as an x-y graph 500*a* with the amplitude on the y-axis, 520*a*, and the frequency on the x-axis, 530*a*. FIG. 5*b* shows similar information to FIG. 5*a* but presents it in a two-dimensional polar plot 500*b* where the distance from the origin is the amplitude of the signals 510*b* and 511*b* and the radians are the various frequencies.

Referring back to FIG. 4, after the collisions are identified in step 430, they may be displayed in step 450. Because the collisions are simply occurrences within frequency and time domain, their representation is most relevant when displayed in conjunction with the associated sound signal waveforms. Thus, as shown in FIG. 5*a* the specific occurrences of collisions are shown in highlighted region 510*a*. Similarly, in FIG. 5*b*, region 510*b* indicates the range of frequencies identified as having collisions. Thus, the display of the collisions is preferably indicated on the sound signal waveforms as highlighted areas where collisions were detected.

Figure 6A:
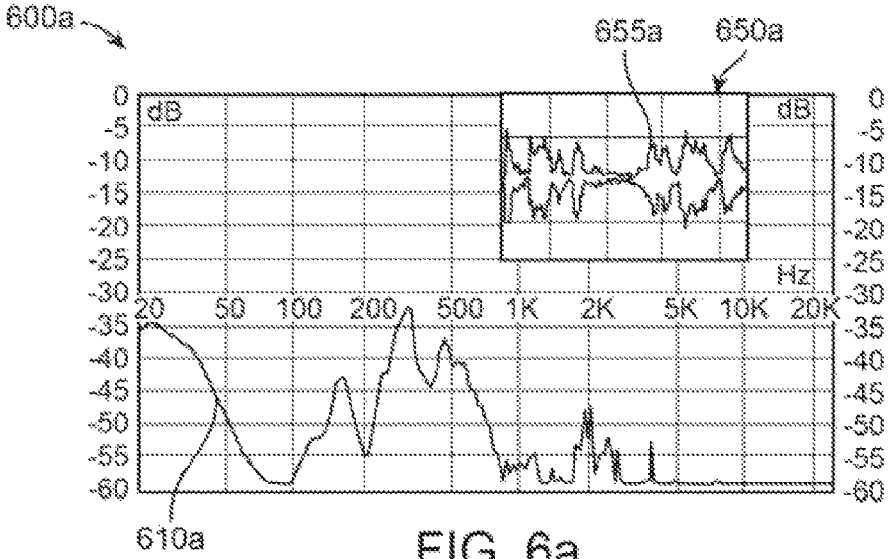
FIG. 6*a*, FIG. 6*b*, and FIG. 6*c* are additional visual outputs of an exemplary method.
Figure 6B:
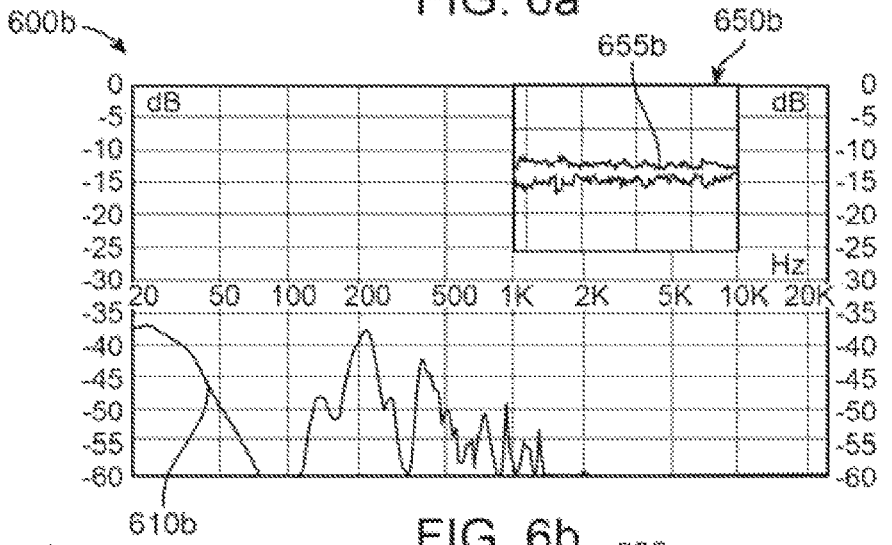
Figure 6C:
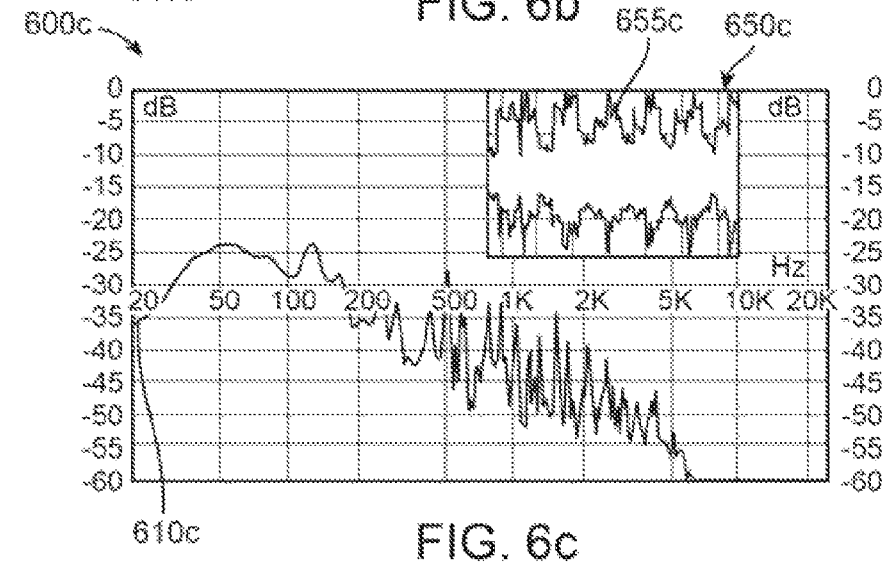

Referring now to FIGS. 6*a*, 6*b*, and 6*c*, graphical waveforms displayed by another preferred embodiment are shown. The display 600*a* in FIG. 6*a* shows the amplitudes of a waveform 610*a* across the frequency spectrum at an instance of time. Also shown in FIG. 6*a* is a representation of the same waveform over a period of time in inset graph 650*a*. When presented with a display such as the ones shown in FIGS. 6*a*, 6*b*, and 6*c*, a user may be able to select a portion in time on the inset graph 650*a* and cause the frequency spectrum 610*a* to be shown. In a preferred embodiment a display 600 may be shown for each sound signal channel, enabling the user to see them all at once, both before and after any algorithms are applied. The user may be presented with any number of options relating to what sort of algorithm to apply to the signals—from volume control to filtering at specific frequencies to attenuating only in the areas where collisions are identified. Additionally, locations of where collisions have been identified may be highlighted such that the user may quickly go to and inspect the signal graphs at those particular locations.

Providing visual indication of the collisions may assist a user in seeing how changes affect the waveforms and whether additional collisions exist.

Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor as discussed above. By way of example, and not limitation, such non-transitory computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those of skill in the art will appreciate that other embodiments of the disclosure may be practiced in network computing environments with many types of computer system configurations, including personal computers, hand-held devices, tablet PCs, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

The various embodiments described above are provided by way of illustration only and should not be construed to limit the scope of the disclosure. Those skilled in the art will readily recognize various modifications and changes that may be made to the principles described herein without following the example embodiments and applications illustrated and described herein, and without departing from the spirit and scope of the disclosure.

We claim:

1. A method comprising:

identifying a first frequency band contained within a first audio signal and a second audio signal, wherein the first audio signal is determined to have a higher priority than the second audio signal, wherein the priority of each audio signal in the first frequency band is determined based on its relevance, and wherein the first and second audio signals have an amplitude above a predetermined threshold;

generating a first dynamic masking algorithm based on the identifying of the first and second audio signals;

applying the first dynamic masking algorithm to the second audio signal to attenuate the second audio signal in the first frequency band; and combining the first and second audio signals for output.

2. The method of claim 1, the identifying further comprising:

sampling a portion of the first and second audio signals to yield a first sampled signal and a second sampled signal;

converting the first and second sampled signals into the frequency domain;

measuring the amplitude of the first sampled signal within the first frequency band;

measuring the amplitude of the second sampled signal within the first frequency band; and wherein the first frequency band is identified by both first and second audio signals when both the first and second sampled signals have an amplitude above the threshold value in the first frequency band.

3. The method of claim 1, the identifying further comprising:

applying a band-pass filter to the first and second audio signals to produce a first filtered signal and a second filtered signal, the band-pass filter being tuned to block out substantially all of the frequencies that are not in the first band;

measuring the amplitude of the first audio signal within the first frequency band;

measuring the amplitude of the second audio signal within the first frequency band; and wherein the first and second audio signals are determined to occupy a first frequency band when both the first and second audio signals are measured to have an amplitude above the threshold value.

4. The method of claim 1, wherein the first dynamic masking algorithm attenuates the second audio signal in all frequency bands.

5. The method of claim 1, wherein the first dynamic algorithm does not attenuate the second audio signal when the amplitude of the first signal is greater than the second signal by a predetermined value.

6. The method of claim 1, wherein the first and second audio signals are parsed into a plurality of samples and the applying of the first dynamic masking algorithm to the second signal occurs once per sample.

7. The method of claim 1, wherein the first audio signal is assigned a priority value that is greater than a priority value of the second audio signal.

8. The method of claim 7, wherein the priority values of the signals are determined based on a weighted average and range of frequency bands contained within the signals.

9. The method of claim 1, wherein the first dynamic masking algorithm attenuates the second audio signal by applying an adaptive filter having a rejection range substantially similar to the first frequency band.

10. The method of claim 1, wherein the first dynamic masking algorithm attenuates the second audio signal by applying a first analog filter to the second audio signal, the first analog filter being configured to substantially block frequencies in the first frequency band.

11. The method of claim 1, wherein the first dynamic masking algorithm attenuates the second audio signal by summing the second audio signal with a first masking signal, the first masking signal occupying the first frequency band and being in antiphase with the second audio signal, wherein the second audio signal is cancelled out in the first frequency band.

12. The method of claim 1, the method further comprising:

applying a second dynamic algorithm to the first audio signal by amplifying the first audio signal in the first frequency band.

13. The method of claim 1, the method further comprising:

presenting graphical waveforms of the first and second audio signals; and indicating on the waveforms where the first and second audio signals occupy the same frequency band.

14. A system for mixing audio signals, the system comprising:

a processing system;

a memory coupled to the processing system, wherein the processing system is configured to:

identify a first frequency band contained within a first and second audio signal, wherein the first audio signal is determined to have a higher priority than the second audio signal, wherein the priority of each audio signal in the first frequency band is determined based on its relevance, and wherein the first and second audio signals have an amplitude above a predetermined threshold;

generate a first dynamic masking algorithm based on the identifying of the first and second audio signals;

apply the first dynamic masking algorithm to the second audio signal to attenuate the second audio signal in the first frequency band; and combine the first and second audio signals for output.

15. The system of claim 14, the processing system further configured to:

sample a portion of the first and second audio signals to yield a first sampled signal and a second sampled signal;

transform the first and second sampled signals into the frequency domain;

measure the amplitude of the first sampled signal and the second sample signal within the first frequency band; and determine whether both the first and second sampled signals have an amplitude above the threshold value in the first frequency band.

16. The system of claim 14, the processing system further configured to:

apply a band-pass filter to the first and second audio signals to produce a first filtered signal and a second filtered signal, the band-pass filter being tuned to block out substantially all of the frequencies that are not in the first band;

measure the amplitude of the first filtered signal and the second filtered signal within the first frequency band; and determine whether both the first and second filtered signals have an amplitude above the threshold value in the first frequency band.

17. The system of claim 14, wherein the first dynamic masking algorithm attenuates the second audio signal in all frequency bands.

18. The system of claim 14, wherein the first dynamic algorithm does not attenuate the second audio signal when the amplitude of the first audio signal is greater than the second audio signal by a predetermined value.

19. The system of claim 14, wherein the first and second audio signals are parsed into a plurality of samples and the applying of the first dynamic masking algorithm to the second audio signal occurs once per sample.

20. The system of claim 14, wherein the first audio signal has a priority value that is greater than a priority value of the second audio signal.

21. The system of claim 20, wherein the priority values of the signals are determined based on a weighted average and range of frequency bands contained within the signals.

22. The system of claim 14, wherein the first dynamic masking algorithm attenuates the second audio signal by applying an adaptive filter having a rejection range substantially similar to the first frequency band.

23. The system of claim 14, wherein the first dynamic masking algorithm attenuates the second audio signal by applying a first analog filter to the second signal, the first analog filter being configured to substantially block frequencies in the first frequency band.

24. The system of claim 14, wherein the first dynamic masking algorithm attenuates the second audio signal by summing the second audio signal with a first masking signal, the first masking signal occupying the first frequency band and being in antiphase with the second signal, wherein the second audio signal is cancelled out in the first frequency band.

25. The system of claim 14, the processing system further configured to:

apply a second dynamic algorithm to the first audio signal by amplifying the first audio signal in the first frequency band.

26. The system of claim 14, the processing system further configured to:

present graphical waveforms of the first and second audio signals; and indicate on the waveforms where the first and second audio signals occupy the same frequency band.

27. A non-transitory computer-readable storage medium storing instructions which, when executed by a computing device, cause the computing device to mix a plurality of audio signals into a single signal, the instructions comprising:

identifying a first frequency band contained within a first and a second audio signal, wherein the first audio signal is determined to have a higher priority than the second audio signal, wherein the priority of each audio signal in the first frequency band is determined based on its relevance, and wherein the first and second audio signals have an amplitude above a predetermined threshold;

generating a first dynamic masking algorithm based on the identifying of the first and second audio signals;

applying the first dynamic masking algorithm to the second audio signal to attenuate the second audio signal in the first frequency band; and combining the first and second audio signals for output.

28. The non-transitory computer-readable storage medium of claim 27, the determining instructions comprising:

sampling a portion of the first and second audio signals to yield a first sampled signal and a second sampled signal;

converting the first and second sampled signals into the frequency domain;

measuring the amplitude of the first sampled signal within the first frequency band;

measuring the amplitude of the second sampled signal within the first frequency band; and wherein the first frequency band is identified by both first and second signals when both the first and second sampled signals have an amplitude above the threshold value in the first frequency band.

29. The non-transitory computer-readable storage medium of claim 27, the determining instructions comprising:

applying a band-pass filter to the first and second audio signals to produce a first filtered signal and a second filtered signal, the band-pass filter being tuned to block out substantially all of the frequencies that are not in the first band;

measuring the amplitude of the first audio signal within the first frequency band;

measuring the amplitude of the second audio signal within the first frequency band; and wherein the first and second audio signals are determined to occupy a first frequency band when both the first and second audio signals are measured to have an amplitude above the threshold value.

30. The non-transitory computer-readable storage medium of claim 27, wherein the first dynamic masking algorithm attenuates the second audio signal in all frequency bands.

31. The non-transitory computer-readable storage medium of claim 27, wherein the first dynamic algorithm does not attenuate the second audio signal when an amplitude of the first signal is greater than the second signal by a predetermined value.

32. The non-transitory computer-readable storage medium of claim 27, wherein the first and second audio signals are parsed into a plurality of samples and the applying of the first dynamic masking algorithm to the second signal occurs once per sample.

33. The non-transitory computer-readable storage medium of claim 27, wherein the first audio signal is assigned a priority value that is greater than a priority value of the second audio signal.

34. The non-transitory computer-readable storage medium of claim 33, wherein the priority values of the audio signals are determined based on a weighted average and range of frequency bands contained within the signals.

35. The non-transitory computer-readable storage medium of claim 27, wherein the first dynamic masking algorithm attenuates the second audio signal by applying an adaptive filter having a rejection range substantially similar to the first frequency band.

36. The non-transitory computer-readable storage medium of claim 27, wherein the first dynamic masking algorithm attenuates the second audio signal by applying a first analog filter to the second audio signal, the first analog filter being configured to substantially block frequencies in the first frequency band.

37. The non-transitory computer-readable storage medium of claim 27, wherein the first dynamic masking algorithm attenuates the second audio signal by summing the second signal with a first masking signal, the first masking signal occupying the first frequency band and being in antiphase with the second audio signal, wherein the second audio signal is cancelled out in the first frequency band.

38. The non-transitory computer-readable storage medium of claim 27, the method further comprising:

applying a second dynamic algorithm to the first audio signal by amplifying the first signal in the first frequency band.

39. The non-transitory computer-readable storage medium of claim 27, the method further comprising:

presenting graphical waveforms of the first and second audio signals; and indicating on the waveforms where the first and second audio signals occupy the same frequency band.

* * * * *